US010548358B2

(12) United States Patent
Roberts

(10) Patent No.: US 10,548,358 B2
(45) Date of Patent: Feb. 4, 2020

(54) SUIT FOR ATHLETIC ACTIVITIES

(71) Applicant: Under Armour, Inc., Baltimore, MD (US)

(72) Inventor: Maxi Roberts, Baltimore, MD (US)

(73) Assignee: UNDER ARMOUR, INC., Baltimore, MD (US)

( * ) Notice: Subject to any disclaimer, the term of this patent is extended or adjusted under 35 U.S.C. 154(b) by 136 days.

(21) Appl. No.: 15/678,700

(22) Filed: Aug. 16, 2017

(65) Prior Publication Data

US 2018/0049486 A1 Feb. 22, 2018

Related U.S. Application Data

(60) Provisional application No. 62/375,626, filed on Aug. 16, 2016.

(51) Int. Cl.
*A41D 13/02* (2006.01)
*A41D 27/24* (2006.01)

(52) U.S. Cl.
CPC ..... *A41D 13/02* (2013.01); *A41D 27/24* (2013.01); *A41D 2200/20* (2013.01); *A41D 2400/24* (2013.01); *A41D 2600/10* (2013.01)

(58) Field of Classification Search
CPC ..... A41D 13/02; A41D 27/24; A41D 27/245; A41D 1/12; A41D 1/08; A41D 13/0015; A41D 2400/24; A41D 2600/10; A41D 2200/20; A41D 1/007; A41D 1/084; A41D 1/089; A41D 7/00; A41D 7/005; A41D 13/012; A41D 1/06
USPC ..... 2/2.15
See application file for complete search history.

(56) References Cited

U.S. PATENT DOCUMENTS

| | | | | |
|---|---|---|---|---|
| 2,748,551 A | | 6/1956 | Garbellano | |
| 3,396,406 A | * | 8/1968 | Gongwer | B63C 11/04 2/2.15 |
| 3,813,697 A | * | 6/1974 | Belpaume | A41D 1/06 2/227 |
| 3,835,470 A | | 9/1974 | Greiter | |
| 4,176,408 A | * | 12/1979 | de Polo | A41D 1/007 2/227 |
| 4,179,754 A | | 12/1979 | Denu | |
| 4,268,238 A | | 5/1981 | Marc | |
| 4,306,317 A | | 12/1981 | Joseph | |
| 4,368,547 A | * | 1/1983 | dePolo | A41D 1/06 2/227 |
| 4,441,876 A | | 4/1984 | Marc | |
| 4,524,037 A | | 6/1985 | Marc | |
| 4,851,167 A | | 7/1989 | Marc | |

(Continued)

FOREIGN PATENT DOCUMENTS

| | | |
|---|---|---|
| DE | 2935780 A1 | 4/1981 |
| EP | 0962313 A1 | 8/1999 |

(Continued)

*Primary Examiner* — Amy Vanatta
(74) *Attorney, Agent, or Firm* — Edell, Shapiro & Finnan, LLC

(57) ABSTRACT

A suit wearable by a human user includes a torso section, two arm sections extending from an upper portion of the torso section, and two leg sections extending from a lower portion of the torso section. The suit further includes at least one seam that connects portions of the suit together and extends across a leg section, where the seam is asymmetrical in relation to a lengthwise dimension of the suit.

14 Claims, 2 Drawing Sheets

(56) References Cited

U.S. PATENT DOCUMENTS

| | | | | |
|---|---|---|---|---|
| 4,972,522 | A | 11/1990 | Rautenberg | |
| 5,033,116 | A | 7/1991 | Itagaki et al. | |
| 5,052,053 | A | 10/1991 | Peart et al. | |
| 5,359,735 | A | 11/1994 | Stockwell | |
| 5,371,903 | A | 12/1994 | Lew | |
| 5,380,578 | A | 1/1995 | Rautenberg | |
| 5,415,924 | A | 5/1995 | Herlihy, Jr. | |
| 5,631,074 | A | 5/1997 | Herlihy, Jr. | |
| 5,734,990 | A | 4/1998 | Waring | |
| 5,809,567 | A | 9/1998 | Jacobs et al. | |
| 5,819,322 | A | 10/1998 | Dicker et al. | |
| 5,836,016 | A | 11/1998 | Jacobs et al. | |
| 5,887,280 | A | 3/1999 | Waring | |
| D409,819 | S | 5/1999 | Gilchrist | |
| 6,098,198 | A | 8/2000 | Jacobs et al. | |
| 6,343,381 | B1* | 2/2002 | Sirakova | A41D 1/007 2/243.1 |
| D460,242 | S | 7/2002 | Fairhurst et al. | |
| 6,430,752 | B1* | 8/2002 | Bay | A41C 1/003 2/228 |
| 6,438,755 | B1 | 8/2002 | MacDonald et al. | |
| 6,484,319 | B1 | 11/2002 | Fusco et al. | |
| 6,546,560 | B2 | 4/2003 | Fusco et al. | |
| D485,048 | S | 1/2004 | Janes | |
| D510,175 | S | 10/2005 | Ragot et al. | |
| D553,297 | S | 10/2007 | Sumpter | |
| D602,677 | S | 10/2009 | Cowan | |
| D608,981 | S | 2/2010 | Cowan | |
| 7,856,668 | B2 | 12/2010 | Demarest et al. | |
| 7,941,869 | B2 | 5/2011 | Wright et al. | |
| 8,082,595 | B2 | 12/2011 | Nordstrom | |
| 8,185,971 | B2 | 5/2012 | Wright et al. | |
| 8,286,262 | B2 | 10/2012 | Rance et al. | |
| 8,347,413 | B2 | 1/2013 | Wright et al. | |
| 8,375,465 | B2 | 2/2013 | Whaley | |
| 8,539,615 | B1 | 9/2013 | Carver | |
| 8,548,622 | B2 | 10/2013 | Berns et al. | |
| 8,745,769 | B2 | 6/2014 | Wright et al. | |
| 8,784,347 | B1 | 7/2014 | Smith | |
| D730,583 | S | 5/2015 | Read | |
| D774,727 | S | 12/2016 | McCombs | |
| D824,143 | S | 7/2018 | Witherspoon et al. | |
| 2001/0004771 | A1* | 6/2001 | Chou | A41D 1/007 2/227 |
| 2006/0085889 | A1 | 4/2006 | Okajima | |
| 2006/0200890 | A1 | 9/2006 | Prat Gonzalez | |
| 2006/0277653 | A1 | 12/2006 | Okajima | |
| 2008/0196136 | A1 | 2/2008 | Fellouhe et al. | |
| 2008/0078008 | A1 | 4/2008 | Demarest et al. | |
| 2008/0141431 | A1 | 6/2008 | Rance et al. | |
| 2008/0189825 | A1 | 8/2008 | Wright et al. | |
| 2010/0011479 | A1* | 1/2010 | Onoda | A41D 7/00 2/67 |
| 2010/0077527 | A1* | 4/2010 | Lee | A41D 13/0015 2/69 |
| 2011/0162122 | A1 | 7/2011 | Wright et al. | |
| 2012/0131720 | A1 | 5/2012 | Nordstrom et al. | |
| 2012/0174282 | A1 | 7/2012 | Newton et al. | |
| 2012/0266353 | A1 | 10/2012 | Ferre | |
| 2012/0304359 | A1 | 12/2012 | Bybee et al. | |
| 2013/0198926 | A1 | 8/2013 | Rod, III et al. | |
| 2013/0212767 | A1 | 8/2013 | Nordstom et al. | |
| 2013/0212769 | A1* | 8/2013 | Lubets | A41D 13/0015 2/69 |
| 2013/0298306 | A1* | 11/2013 | Tumer | A41D 1/08 2/115 |
| 2014/0313037 | A1 | 10/2014 | Canales et al. | |
| 2017/0027248 | A1 | 2/2017 | McFarlane et al. | |
| 2017/0079339 | A1 | 3/2017 | Yeomans et al. | |
| 2017/0215492 | A1 | 8/2017 | Canales et al. | |
| 2018/0035727 | A1 | 2/2018 | Cumiskey et al. | |

FOREIGN PATENT DOCUMENTS

| | | | |
|---|---|---|---|
| JP | H03137203 | A | 6/1991 |
| JP | H03137204 | A | 6/1991 |
| JP | H07331513 | A | 12/1995 |
| JP | H10140407 | A | 5/1998 |
| JP | H10280222 | A | 10/1998 |
| JP | 2000064107 | A | 2/2000 |
| JP | 2003105608 | A | 4/2003 |
| JP | 2006037311 | A | 2/2006 |
| NL | 198800542 | A | 10/1989 |
| NL | 1040558 | C | 6/2015 |
| RU | 2518994 | C1 | 6/2014 |
| WO | 9708966 | A1 | 3/1997 |
| WO | 0045658 | A1 | 8/2000 |
| WO | 2009133433 | A1 | 11/2009 |
| WO | 2010072811 | A1 | 7/2010 |
| WO | 2010151684 | A1 | 12/2010 |
| WO | 2011003102 | A1 | 1/2011 |
| WO | 2011146387 | A1 | 11/2011 |
| WO | 2013028370 | A1 | 2/2013 |

* cited by examiner

SUIT FOR ATHLETIC ACTIVITIES

FIELD

The present invention relates to uniforms or suits for athletic activities and, in particular, to an aerodynamic garment.

BACKGROUND

Racing competitions for human athletes, in particular speed skating competitions (e.g., at an elite level), typically include gear designed for optimum performance by the athlete. Suits and other apparel associated with a particular racing sport are designed to reduce drag on the athlete. For example, in speed skating sports as well as other sports in which an athlete is moving at a rapid speed within an environment, suits are typically worn by athletes that adhere tightly and conform to the profile of an athlete's body so as to provide a streamlined contour as the athlete moves through the air or other fluid environment of a racing competition.

When performing at an ultra-elite level (e.g., competitions between the best and fastest athletes world-wide, such as an Olympic event), any feature that can reduce wind resistance and drag reduction on an athlete can enhance the athlete's performance in a racing event (e.g., increasing the athlete's speed and performance during the event, reducing the athlete's event time by fractions of seconds, etc.). In particular, certain movements associated with speed skaters as they move around the track can result in wrinkles forming in the skater's suit that can increase wind resistance and drag on the user, in turn detrimentally affecting skater speed and performance. Similar issues can occur for cycling racers and other high performance athletic racers.

Accordingly, it would be desirable to provide a racing suit that enhances drag reduction and reduces the formation of wrinkles during movements when worn by an athlete so as to improve the athlete's performance in a racing event.

SUMMARY

In an embodiment, an article of apparel or garment for athletic activities (e.g., a suit) comprises a torso section, two arm sections extending from an upper portion of the torso section, and two leg sections extending from a lower portion of the torso section. The garment further includes at least one seam that connects portions of the garment together and extends across a leg section, wherein the at least one seam is asymmetrical in relation to a lengthwise dimension of the garment. The asymmetrical seam can permit free motion of the leg, lowering the energy expenditure of the user during the motion cycle. Additionally, the asymmetrical seam aligns along the article of apparel to minimize wrinkles formed along the garment during use. The garment can further include other portions that are selectively modified to provide the garment with a desired aerodynamic profile.

In another embodiment, the garment includes a first (e.g., left) body portion and a second (e.g., right) body portion disposed on opposite sides of a central axis oriented vertically such that the axis extends along the length (head to toe dimension) of the garment. The first body portion includes a single seam extending from the front to rear side of the garment. The second body portion includes a primary or upper seam section and a secondary or lower seam section spaced from the primary seam section, where the primary and secondary seam sections extend around the waist or hip region of the garment that corresponds with the right hip and right leg of the user.

In a further embodiment, the garment is worn by a user while engaging in a sporting activity (e.g., a speed skating activity).

In still another embodiment, a suit wearable by a human user comprises left and right leg sections extending from a midsection of the suit, where the leg sections are defined by a continuous fabric section of the suit that extends along a portion of the left leg section of the suit and further extends across a front side of the suit to cover a right hip portion and also a portion of a rear side of the suit, the first continuous fabric section being defined by a seam that is asymmetrical in relation to a lengthwise dimension of the suit.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

BRIEF DESCRIPTION OF THE DRAWINGS

Like reference numerals have been used to identify like elements throughout this disclosure.

DETAILED DESCRIPTION

Aspects of the disclosure are disclosed herein. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

Further, the terms "comprising," "including," "having," and the like, as used with respect to embodiments of the present disclosure, are synonymous.

As described herein, an article of apparel or garment for athletic activities may be in the form of a suit including a main body or torso, arm sleeves, leg sleeves, and a hood extending from the torso section. The different portions or sections of the suit are suitably dimensioned to respectively conform to a human wearer or user's torso, head, arms and legs when worn by the user engaging in athletic activities. The suit includes wind resistance or drag reduction features provided at suitable locations along portions of the suit to enhance user performance during the activities. In particular, the suit as described herein provides beneficial features in reducing wind resistance and drag for a speed skater wearing the suit during a speed skating event.

Figure 2:
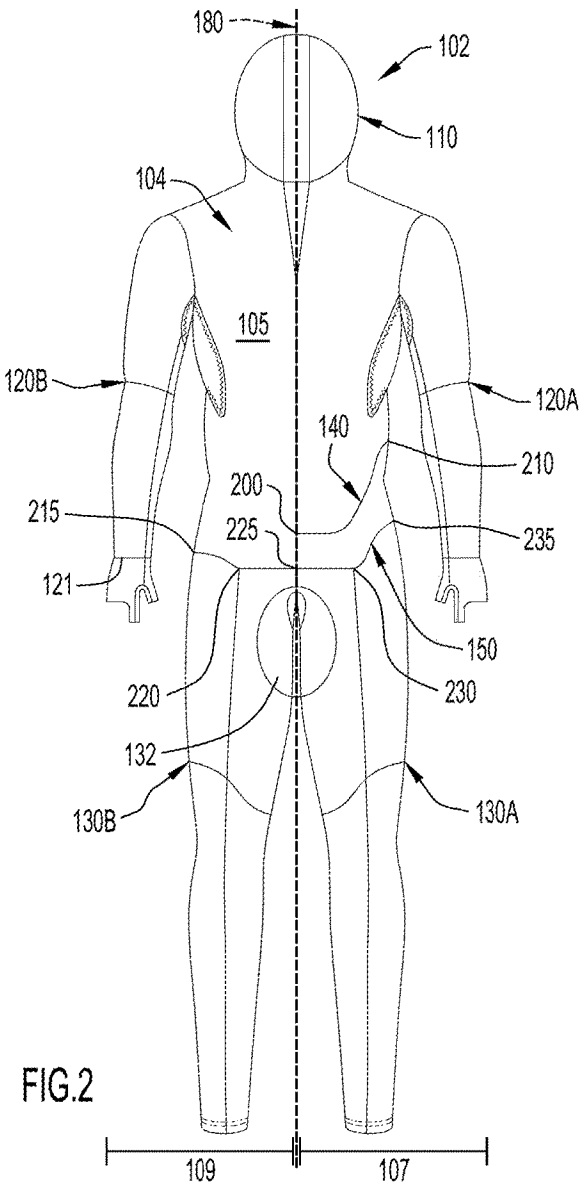
FIG. 2 is a rear view of the suit worn by the user of FIG. 1.

An example embodiment of an article of apparel or garment in accordance with the present invention is described with reference to FIGS. 1-4. As illustrated, the garment is in the form of a full body suit such as a speed skating suit 102. The speed skating suit 102 includes a main body or torso 104, a head covering 110, a first or right arm sleeve 120A, a second or left arm sleeve 120B, a first or right leg sleeve 130A, and a second or left leg sleeve 130B. The hood 110, arm sleeves 120A, 120B and leg sleeves 130A, 130B are coupled with the torso 104 in a suitable alignment and suitably dimensioned so as to fit comfortably over while conforming to corresponding portions of the user's body (e.g., the user's head, arms and legs as can be seen in the figures). With this configuration, the suit 102 defines a front suit side 103 (FIG. 1) and a rear suit side 105 (FIG. 2). Additionally, a central axis or plane 180 bisects the suit 102 to define a right suit side 107 (FIG. 3) and a left suit side 109 (FIG. 4) (i.e., the left and right sides of the suit are divided by suit centerline).

The suit 102 covers a significant portion of the user's body (as shown, e.g., in FIG. 1), leaving only portions of the user's hands, feet and face exposed. In particular, the torso 104 generally covers the trunk of the user. The head covering 110 may be in the form of a hood that covers the crown, back, nape, and ears of the user. Each arm sleeve 120A, 120B is a generally cylindrical tube tapering in diameter toward the arm sleeve distal end, where the arm sleeves can be constructed of the same or different materials at different locations along the arm sleeve. Each arm sleeve 120A, 120B can terminate in an end 121 that is located at or near the wrist of the wearer or user. In other embodiments, the terminal end 121 of each sleeve 120A, 120B can extend beyond the user's wrist to terminate in a glove-like configuration that extends over portions of some of the digits of the user's hand while including one or more openings that allow exposure of the terminal end(s) of one or more digits of the user's hand. Similarly, each leg sleeve 130A, 130B is a generally cylindrical tube tapering in diameter toward the leg sleeve distal end, where each leg sleeve is further of sufficient length to extend beyond the knee of the user, terminating at or near the user's ankle.

Figure 1:
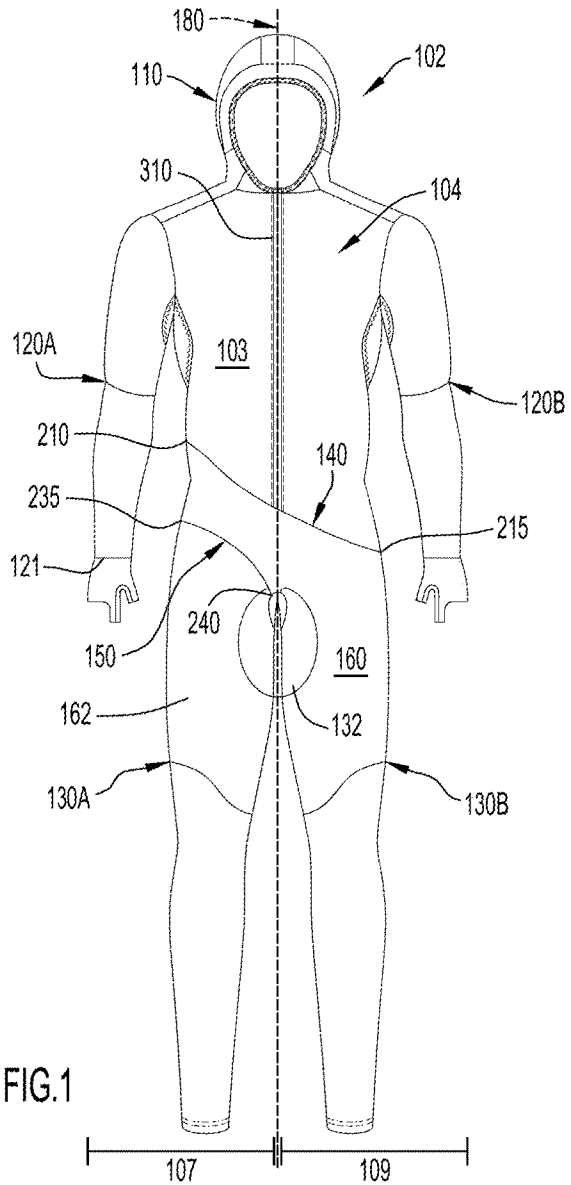
FIG. 1 is a front view of an example embodiment of a speed skating suit worn by a user in accordance with the present invention.
Figure 3:
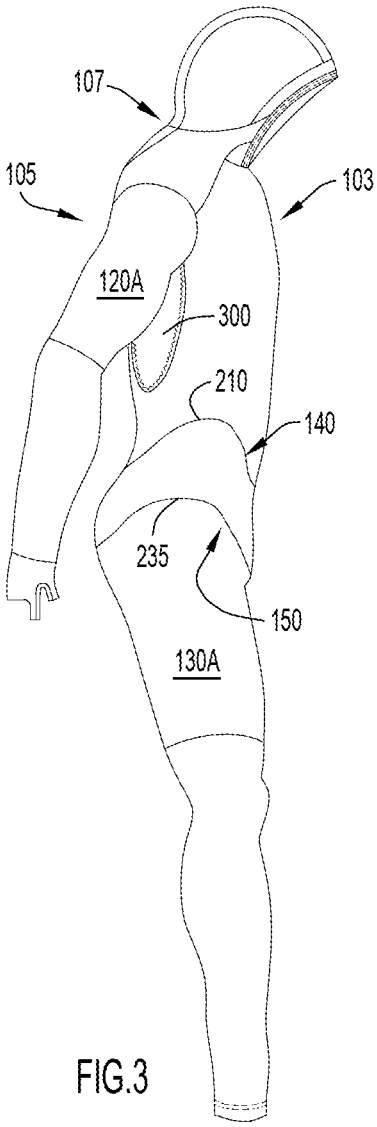
FIG. 3 is a right side view of the suit worn by the user of FIG. 1.
Figure 4:
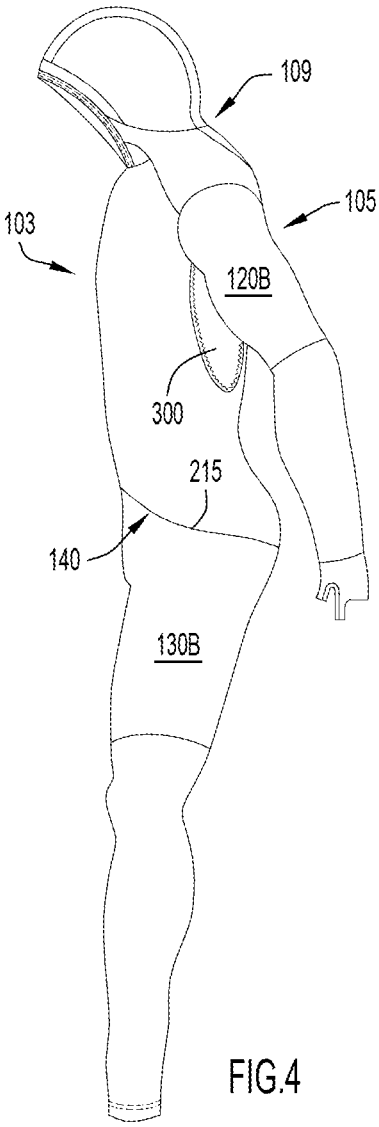
FIG. 4 is a left side view of the suit worn by the user of FIG. 1.

Each leg sleeve 130A, 130B can further include an inner thigh region 132 that extends toward the crotch of the suit 102 and includes a slippery or low friction material on the exterior of the inner thigh regions that reduces or eliminates friction between the two inner thigh regions during athletic movements by the user (e.g., during rapid movements of the user's thighs in opposing directions when the user is engaging in a skating activity). The inner thigh regions 132 including the slippery or low friction material can extend around to cover portions of both the front side 103 and rear side 105 of the suit (as depicted in FIGS. 1 and 2). The low friction area between the corresponding inner thigh regions 132 is such that the coefficient of friction due to contact between these two regions during user movements is low. In an example embodiment, the thigh regions 132 include a suitable low friction material such as a reflective stretch overlay film formed of elastomeric polyurethane that is commercially available, e.g., from Bemis Associates Inc. (Massachusetts, USA) under the tradenames RS3000 and OT-100RS.

When worn, the suit 102 provides a generally contoured fit over portions of the user's body. In particular, the torso 104 covers the user's torso or main body portion, and the hood 110 provides a covering for a portion of the user's head, including the portions of the user's head including hair and the user's ears, while leaving the user's face including chin and, optionally, a part of the user's neck exposed. Each leg sleeve 130A, 130B extends over a corresponding leg of the user from the user's trunk to a location below the knee (e.g., proximate the user's ankle). Each arm sleeve 120A, 120B extends over a corresponding arm of the user from the user's trunk to the user's corresponding hand.

The suit 102 further includes a seam configuration operable to minimize interference with leg movement and improve the aerodynamic properties of the garment. As used herein, a seam refers to a boundary, line or join at which two or more pieces of fabric are joined together, where the pieces of fabric can be connected together at the seam in any suitable manner (e.g., via stitching, adhesion, melt bonding, etc.).

Speed skating tracks (e.g., for Olympic or other speed skating competitions) are typically circular or elliptical in shape, where speed skaters move in a counter clockwise direction along the speed skating track. During a speed skating event, the skater is typically oriented in a bent or crouched position, where the skater leans forward such that the head and torso of the skater are located in front of the skater's legs. In addition, the legs of the skater move in a particular pattern to propel the skater forward along the track as fast and efficiently as possible. Given the shape and direction of movement along the track, the skater must make left turning movements along the track as the skater approaches curved portions of the track. Such left turning movements typically require an alignment of the skater's body, in which the skater's right leg crosses over the skater's left leg during propelling movements of the skater around the turn.

In light of the positioning and movement, speed skating suits are configured with adequate stretch properties to accommodate movement of the athlete. In addition, conventional suits include a horizontal seam proximate the waist. Horizontal seams (particularly those oriented along the front of the suit), being positioned with the direction of airflow, are believed to reduce drag (air separation) in comparison to vertical seams. Horizontal seams, however, may introduce other inefficiencies within the suit. A horizontal waist seam may generate a stretch pattern that forms wrinkles along portions of the suit, particularly at the hip. Wrinkles can negatively impact skater performance due to increased wind resistance and drag caused by air separation generated by the wrinkles.

In addition, horizontal seams may increase the biasing force of the garment. The recovery properties of the fabric applies a resilient force as the fabric stretches. With a horizontal seam, a consistent anchor point is created across the suit, with the fabric being pulled as the athlete moves. The athlete must expend energy to overcome the biasing force. In addition, conventional seam may lead to constricting the movement of the athlete and, in particular, the critical crossing leg motion. Horizontal seams to not account for the unique leg motion of speed skaters, where legs are angularly displaced relative the torso. Accordingly, conventional seam construction may result in increased energy expenditure by the wearer during the course of the race.

In light of the above, providing a seam configuration that mitigates the biasing force and permits free motion of the legs is desirable. The time for the skater to complete a speed skating event can be increased by fractions of a second due to the presence of wrinkles in the skater's suit or minimal fatigue, which can make a difference between winning and losing the event (or even setting a new world record in a particular skating event).

A suit in accordance with an embodiment of the invention includes a seam configuration with a non-horizontal seam proximate the waist. The seam may be a single, continuous coiled around the waist and/or hips of the athlete, beginning and terminating proximate the suit centerline axis 180. Alternatively, a plurality of seams may be provided instead of a single, continuous seam. In a specific embodiment, seam includes sections or portions that are asymmetrically aligned along the suit. Referring to the embodiment depicted in FIGS. 1-4, the suit 102 includes a seam configuration comprising a single seam that travels around the athlete along a specific pathway, e.g., a coiling pathway beginning proximate the garment centerline along on one side of the garment, encircling the athlete and ending proximate the garment centerline on the opposite side of the garment. As shown, the seam may possesses a travel path beginning along the rear suit side 105 at the centerline axis 180 (FIG. 2), extends along the right suit side 107 (making a first pass) (FIG. 3), across the front suit side 103 (FIG. 1), along the left suit side 109 (FIG. 4), across the entire rear suit side 105 (FIG. 2), and again along the right suit side 107 (making a second pass) (FIG. 3), and terminating at the centerline axis 180 along suit front side 103 (FIG. 1).

In a further embodiment, the right side 107 of the suit 102 includes two strategically placed seam sections (each with a specific travel path), while the left side 109 of the suit includes a single seam section. The right suit side 107 includes a first or primary seam section 140 (identifying the first pass of the seam within an area of the suit) and a second or secondary seam section 150 (identifying the second or overlapping pass of the seam within an area of the suit). Along the front suit side 103, each seam section 140, 150 inclines as it travels laterally across the suit (i.e., in a dimension transverse a lengthwise dimension of the suit) from right suit side 107 at or near the right hip toward the left side (i.e., the suit centerline 180). As shown, along the front side 103 of the suit 102, the secondary seam section 150 is positioned lower relative to the primary seam section 140 (i.e., at the suit front side 103, the primary seam section is above the secondary seam section and thus is closer in distance to upper portions of the suit, such as the hood 110, in relation to the secondary seam section).

Referring to FIG. 2, the primary seam section 140 begins at location 200, proximate the suit centerline or suit axis 180 at a position proximate the user's spine and above the crotch. The primary seam section 140 extends in a curved and/or convex manner (where the convex orientation is defined with the suit being oriented an in upright position as worn by the user) along the right side 107 (FIG. 3) of the suit 102 and outer or lateral side of the right leg sleeve 130A and toward the front side 103 (FIG. 1) of the suit. As shown best in FIG. 3, the primary seam section 140 is arched, extending upward to apex proximate location 210 along the right suit side 107 (configured to be oriented at or above the user's hip along suit front side 103) and then downward as it transitions to suit front side 103.

The primary seam section 140 continues, traveling laterally along the front side 103 from location 210 that is at the front right side of the suit at or, preferably, configured to be positioned above the user's right hip (e.g., where the user's right hip is at a location defined by the ball and socket connection between the user's right leg and right hip). The primary seam section 140 extends along the front side 103, traveling across the torso 104 and in an inclined (diagonal and downward direction), through the centerline axis 180 and into the left suit side 109 to a location 215 generally corresponding with the user's left hip joint (e.g., the ball and socket joint connection of the user's left leg with the user's left hip joint). As is evident at the front side 103 of the suit 102 (FIG. 1), location 210 of the primary seam section 140 at the suit front right side is above or higher on the suit (i.e., closer in distance to the hood 110) in relation to location 215 of the primary seam section at the suit front left side 109.

At the left side 109 of the suit 102 (FIG. 4), the primary seam section 140 extends generally along the user's left hip toward the rear side 105 in a curved manner along the left leg sleeve 130B, where the primary seam section 140 extends from location 215 to location 220 on the rear suit side 105. Primary seam location 220 is lower than the primary seam location 215 as the primary seam 140 extends from the front suit side 103 (FIG. 1), around the left suit side 109 (FIG. 4) and to the rear suit side 105 (FIG. 2). In other words, location 215 of the primary seam section 140 is above and thus closer in distance to an upper terminal portion of the suit 102 (e.g., the upper terminal portion includes the upper torso, shoulder portions, and hood 110) in relation to location 220.

From location 220 (proximate the left buttock), the seam becomes generally horizontal, crossing the suit centerline 180 at location 225 (proximate spine), entering right suit side 107 where it becomes the second seam section 150. As shown, location 225 of the secondary seam section is positioned lower (e.g., 35-75 mm lower) than location 200 of the primary seam section 140. The second seam section 150 maintains its horizontal orientation until location 230 (proximate right buttock). As with the primary seam section 140, the secondary seam section 150 extends in a curved and/or convex manner (where the convex orientation is defined with the suit being oriented an in upright position as worn by the user) along the right side 107 (FIG. 3) of the suit 102 and outer or lateral side of the right leg sleeve 130A and toward the front side 103 (FIG. 1) of the suit to location 235 that generally corresponds with the socket joint connection of the user's right leg with the user's right hip.

Location 230 of the secondary seam section 150 is lower than location 235 as the secondary seam section extends from the rear suit side 105 (FIG. 2), around the right side 107 (FIG. 3) and to the front suit side 103 (FIG. 1). In other words, the third location 235 is above and thus closer in distance to an upper terminal portion of the suit 102 (e.g., the upper terminal portion includes the upper torso, shoulder portions, and hood 110) in relation to the fourth location 230.

From location 235 (which generally corresponds to a position at or slightly below the hip joint (e.g., ball and socket connection of the user's right leg with the user's right hip)), the secondary seam section 150 extends laterally along the front side 103 of the suit 102 across the right leg sleeve 130A to a second, central/crotch location 240 of the suit that is below or lower on the suit in relation to the first location 152 (i.e., the first location 152 is above and thus closer in distance to the hood 110 in relation to the second location 154). Unlike the primary seam section 140, the secondary seam section 150 does not extend across the entire width of the suit front side 103 (i.e., from the right front side to the left front side) but instead extends only across the right leg sleeve 130A at the suit front side 103.

With the above described seam configuration, each of the primary seam section 140 and the secondary seam section 150 is asymmetric along a suit centerline 180 extending longitudinally or lengthwise along the suit. For example, the primary seam section 140 extends in a diagonal manner laterally across the entire suit front side 103, and further differs by being positional offset along the left 107 and right side 109 portions of the suit rear side 105 (i.e., location 210 is positioned higher than location 215). The secondary seam section 150, moreover, only extends along a right side portion of the front and rear sides of the suit.

At all locations along the primary and secondary seam sections, the seam sections are located proximate the waist and/or hip portions of the suit 102 (e.g., the primary and secondary seam sections are either above or extend to the crotch of the suit and are further below a location of the torso at which the torso connects with the right and left arm sleeves).

In addition, the overall seam configuration is asymmetric along the central line 180, where two seam sections are located on a right side portion and at a waist or hip region of the suit (i.e., the portion of the suit defined between the suit centerline axis 180 and the right suit side 107 including right arm sleeve 120A and right leg sleeve 130A) while only one seam is located on a left side portion and at the waist or hip region of the suit (i.e., the portion of the suit defined between the central axis 180 and the left suit side including left arm sleeve 120B and left leg sleeve 130B). Stated another way, the combination of the primary seam section 140 and the secondary seam section 150 results in an asymmetric configuration along the lengthwise central axis 180 of the suit. In particular, the right half of the suit (the front suit side 103 and the rear suit side 105 including the right side 107 of the suit that defines a transition between the suit front and rear sides) includes the primary seam section 140 and the secondary seam section 150 (e.g., two seams) along the hip region of the suit (i.e., a region of the suit that transitions from the suit torso 104 to the leg sleeves 130), while the left half of the suit 103 (the front suit side 103 and the rear suit side 105 including the left side 109 of the suit that defines a transition between the suit front and rear sides) includes the primary seam section 140 but not the secondary seam section 150 along the hip region of the suit (e.g., only a single seam along the left side portion of the suit). In other words, and with particular reference to FIGS. 3 and 4, the right side portion of the suit includes more seams (e.g., two seams) that extend laterally along the hip region from suit front side to suit rear side in comparison to the left side portion of the suit (e.g., one seam).

This combination of the primary seam section 140 and secondary seam section 150 define a continuous fabric section 160 in the hip region of the suit 102 that includes at least a portion of the left leg sleeve 130B and a portion of the suit that extends from the suit front side 103 around a portion of the suit right side 107 to the suit rear side 105 at an area covering a portion of the user's right hip. The secondary seam section 150 further separates the fabric section 160 from another fabric section 162 that defines at least a portion of the right leg sleeve 130A at a location below the user's right hip.

The asymmetric positioning of the primary seam section 140 and secondary seam section 150 along portions of the suit 102 (which results in the formation of the fabric section 160) provides a beneficial effect of minimizing, reducing or eliminating the formation of wrinkles along the suit 102 when worn by the user and during use. For example, implementation of the seam sections 140, 150 in the suit 102 can minimize or prevent the formation of wrinkles along portions of the right leg sleeve 130A and/or the left leg sleeve 130B (particularly at locations corresponding with the user's hip on each side of the suit), e.g., during the left turning movements made by the user on the speed skating track (e.g., when the user's right leg crosses over the left leg). While wrinkles in the suit 102 may exist when the user wearing the suit is in a standing position, the primary/secondary seam configuration minimizes or eliminates wrinkles in the suit when the user is bent over in the skating position/use position (e.g., where upper portions of the user's body including the user's head are located forward lower portions of the user's body including portions of the user's legs).

The primary/secondary seam configuration further provides discontinuity between fabric section 160 (which defines at least a portion of the left leg sleeve 130B and a portion of suit material covering the user's right side hip) and fabric section 162 (which defines at least a portion of the right leg sleeve 130A), thus facilitating a greater degree of freedom of movement for the user's right leg during turning movements when the right leg crosses over the left leg. For example, in a suit configuration that does not include the primary and secondary seam sections, the stretch fabric material for the suit covering the user's legs and hips might (due to its snugly or tightly conforming to the user's body) provide some level of constriction or resistance to the user drawing the right leg over or across the left leg during turning movements along the speed racing track. Even when the fabric is resilient, such a constriction requires the athlete to expend energy to overcome the biasing forced placed on the leg.

The discontinuity between fabric section 160 and fabric section 162 (i.e., these sections are separated by the secondary seam section 150 and thus not a single, continuous fabric piece) facilitates an easier, less restrictive movement or enhanced/greater mobility of the user's right leg during the turning movements. Depending upon the types of fabric materials utilized for the fabric sections 160, 162 and the configuration of the primary seam section 140 and the secondary seam section 150, such configuration can even provide the effect of encouraging or applying a slight biasing or compression force to the user's right leg toward making the cross over movements in relation to the user's left leg. Such configuration can further be configured to bias the user wearing the suit into a suitable bent position or posture for enhancing speed skating movements during use.

Accordingly, the garment of the present invention includes features that improve skater performance by reducing or eliminating wrinkles from forming during use of the garment as well as facilitate an alignment of the user/skater in a bent or crouched position and to allow the right leg of the skater to transition more easily across the skater's torso during left turning movements along a curved or rounded track (e.g., when the skater moves in a counter clockwise direction along the rounded track).

Each area of the suit 102 may be formed of any material suitable for its described purpose, and may be formed of the same or different materials. In an embodiment, the torso 104 includes a generally smooth surface, where a significant portion of the torso can be constructed of laminated fabric, such as a knitted or woven fabric including a blend of polyester and spandex (e.g., a knitted blend of about 88% by weight polyester and about 12% by weight spandex) with a thin, continuous film of polyurethane (PU) on its exterior surface. The PU laminate layer possesses a smooth exterior surface for the torso 104. The PU layer of the torso 104 permits little or relatively no air to permeate this layer (i.e., the PU layer is substantially air impermeable or non-breathable with the air).

The hood 110 can be constructed of the same or similar materials as the torso 104, such as a knitted fabric comprising polyester and spandex (e.g., a knitted blend of about 88% polyester and about 12% spandex). The hood 110 can further include a smooth exterior PU layer formed as a laminate over the fabric. In embodiments in which the hood 110 includes the PU layer, the hood can also include one or more air permeable/venting regions similar to such regions of the torso 104. Alternatively, the hood 110 can be constructed substantially of the knitted fabric with little or no portions of the hood covered with the laminated PU layer.

In the example embodiment, portions of each arm sleeve can be constructed of different materials at different portions (e.g., upper or proximate portion, intermediate portion and lower or distal portion) of the arm sleeve in a manner similar to that described in the '709 application. For example, some arm sleeve portions can be constructed of the same or similar materials as the torso 104, including a knitted fabric comprising polyester and spandex (e.g., a knitted blend of about 88% polyester and about 12% spandex) with or without a PU laminate layer over the fabric layer. Other portions of the arm sleeves can include a knitted or woven stretch fabric structure (e.g., including nylon and spandex in amounts of about 70% to about 80% (e.g., about 75%) by weight nylon and about 20% to about 30% (e.g., about 25%) by weight spandex), where the structure of the fabric provides a directional tactile roughness along the exterior surface of the fabric that can vary based upon an alignment of the material in relation to a direction of its movement through air or other fluid medium.

Similarly, each of the leg sleeves 130A, 130B can be constructed of the same or different materials as the arm sleeves at different locations along the leg sleeve. For example, some leg sleeve portions can include a knitted fabric comprising polyester and spandex (e.g., a knitted blend of about 88% polyester and about 12% spandex) with or without a PU laminate layer over the fabric layer. Other portions of the leg sleeves can include a knitted or woven stretch fabric structure (e.g., including nylon and spandex in amounts of about 70% to about 80% (e.g., about 75%) by weight nylon and about 20% to about 30% (e.g., about 25%) by weight spandex), where the structure of the fabric provides a directional tactile roughness along the exterior surface of the fabric having the same or similar characteristics as described for the arm sleeve portions (e.g., having the same or similar type of construction for the leg sleeves as described in the '709 application).

To reduce any overheating by the user of the suit 102, the suit can include air permeable/air venting regions 300 at or near the torso 104 (e.g., along rear portions of the torso 104, at locations under the arm sections 120 at the connection location with the torso 104, at a central crotch region of the suit, etc.) that provide suitable air venting at one or more selected locations within the suit. Each of the air permeable/venting regions can be formed of a suitable elastic material, such as a fabric comprising polyester and spandex and further including a plurality of openings or pores in a selected pattern or arrangement so as to permit breathability or air flow between the suit wearing user and the air environment surrounding the user. In an example embodiment, the air permeable/venting regions can comprise regions that include the fabric layer without the laminated PU layer disposed over the fabric layer. In other embodiments, the air permeable/venting regions can be constructed of a suitable material (e.g., a knitted blend of polyester and spandex), such as a material associated with the trademark HEAT GEAR and commercially available from Under Armour, Inc. (Maryland, USA).

A suitable fastener 310 is provided on the front side 103 of the suit 102 that extends from an upper portion of the torso 104 near the hood 110 to a lower portion of the torso 104 at a suitable location above the crotch (i.e., the section of the suit 102 that defines a joint between torso 104 and leg sleeves 130A and 130B) so as to facilitate separation of left and right portions of the torso 104 when a user is putting on or taking off the suit 102. As shown, the fastener may extend vertically from the hood to the first seam section 140 along the front suit side 103. The fastener 310 can be a zipper structure, where opening of the zipper (i.e., moving the zipper toward the crotch) allows for separation of the left and right portions of the torso 104 while closing of the zipper (i.e., moving the zipper toward the hood 110) joins the left and right portions of the torso 104 together. Alternatively, the fastener 106 can comprise any other suitable fastener structure (e.g., hook and loop fasteners, button/button hole structures, etc.) to facilitate selective separation and joining of the left and right portions of the torso 104 (e.g., to allow the user to take off and put on the suit 102).

Thus, the present invention which incorporates features of one or more asymmetrically aligned seams within a garment (e.g., a speed skating suit) facilitates enhanced user performance in an athletic activity (e.g., a speed skating competition) by minimizing or preventing undesirable wrinkles from forming within the suit when the user is in a certain position during use (e.g., in a bent, speed skating position). Such features also facilitate ease or even impart biasing of certain types of movement by the user (e.g., when wearing the suit, a certain biasing effect results to assist the user to orient his or her body in a bent position and moving his or her right leg to cross over the user's body and left leg when making left turning movements as the user moves forward along a skating track).

While the invention has been described in detail and with reference to specific embodiments thereof, it will be apparent to one skilled in the art that various changes and modifications can be made therein without departing from the spirit and scope thereof. For example, any suitable type of seam or seams can be provided to achieve the desired effect of reducing or eliminating wrinkles in the suit as well as enhance turning movements by the user during use of the suit. The seams can be used to connect any two or more pieces of fabric or other materials together in any suitable manner to form the suit. While the example embodiments described herein and depicted in the figures depict a suit 102 designed with a seam having primary and secondary seam sections with specific configurations along left and right side portions of the suit, the orientations and alignment of primary and secondary seam sections can be reversed (e.g., primary and secondary seam sections on left side portions of suit, while only primary seam section on right side portions of suit) for a particular embodiment including an asymmetric alignment of seams and in which reduction of wrinkles and/or aerodynamic enhancement features are desired. For example the torso of the suit along the rear side may include a seam running longitudinally from the hood to the crotch.

Apart from the seam configuration including a central, single seam that coils around the midsection of the user and including a primary seam section and secondary seam section, the speed skating suit can further be configured with a minimal number of seams (resulting in fewer fabric sections of the suit to be joined together) to minimize air/fluid resistance and enhance user performance. For example, the suit 102 includes no seam along either the right side 107 or left side 109 of the suit that extends in a lengthwise direction of the suit (on the lateral (outer) facing sides of the suit). While other seams on arm and leg sleeves of the suit 102 are positioned to extend circumferentially around the sleeves, this can be for purposes of providing separate fabric and/or other materials along the sleeves (e.g., to provide smooth structures, roughened structures, etc. along the sleeves). The suit can be further designed to eliminate or minimize these and/or other seams that are external to the suit.

Further, while the seam configuration is described herein as a including a central, single seam that coils around the midsection of the user and including a primary seam section and secondary seam section, the seam configuration including primary and secondary seam sections can also be formed with a plurality of seams. For example, the primary seam section can include a primary seam and the secondary seam section can include a secondary seam that is discontinuous in some manner (e.g., interrupted and/or intersected by another seam) from the primary seam.

In another embodiment, a suit can be constructed that is knitted so as to minimize the number of seams required for the suit. For example, a knit suit can be constructed such that the only seams for the suit are primary and secondary seam sections aligned in a configuration similar to that depicted in the embodiment of FIGS. 1-4. In a further embodiment, a knit suit can be constructed to include only primary and secondary seam sections and seams at a connection between arm sleeves and the trunk of the suit. The suit can be knit using any suitable knitting process including, without limitation, warp knitting and weft knitting. For weft knitting, the weft knit process can include circular knitting and/or flat knitting (e.g., circular knitting to form portions of the arm sleeves, leg sleeves and torso). The knitting process can further be configured to form a single knit layer or a plurality of knit layers for the suit.

The materials utilized to form the various sections of the suit include suitable lightweight and sufficiently elastic materials that are stretchable when worn by the user so as to form a tight or snug (i.e., not loose) fit over the user's body. As described herein, some of the materials are air permeable or breathable, while other materials are less air permeable or breathable. Different materials are also provided at different locations of the suit exhibit different degrees of surface friction or skin friction and also different degrees of drag reduction in relation to air (or other fluids) when the user worn suit is moved through the air (or other fluid) environment.

Specifically, the garment (i.e., each section 104, 110, 120A, 120B, 130A, 130B) may be generally formed of one or more resilient textile materials operable to conform to the contours of the user's body. That is, the sections of the suit 102 can be constructed of any suitable fabric or other materials that have elastic and body conforming characteristics as well as other aerodynamic characteristics as described herein. In particular, some or all of the suit sections 104, 110, 120A, 120B, 130A, 130B can be formed, at least in part, with resilient or elastic knitted, woven or nonwoven fabrics comprising one or more (e.g., a blend of) synthetic fibers, where the synthetic fibers can comprise one or more types of polyester-polyurethane copolymers (also referred to as "spandex"), one or more types of nylon (polyamide) polymers, one or more types of polyesters (e.g., polyethylene terephthalate, polybutylene terephthalate, etc.), one or more types of polyolefins, one or more types of polyurethanes, and combinations thereof. Each of the suit sections can further comprise a single fabric layer or a plurality of layers combined via any suitable process (e.g., stitching, adhesion bonding, etc.). In an embodiment, two-way or four-way stretch fabric is used to form some or all of the suit sections.

In particular, each section of the suit 102 can be constructed so as to exhibit different types of aerodynamic characteristics along its exterior surface. In example embodiments, one or more portions of the suit can be formed of one or more different textiles that generate an aerodynamic property and/or include other external features (e.g., vanes, bumps, protrusions, etc.) that enhance the aerodynamic properties of the suit (e.g., reducing drag and air resistance along the exterior surfaces of the suit). For example, some of the suit sections 104, 110, 120A, 120B, 130A, 130B (or portions of each section) can be constructed to have relatively smooth exterior surface features with low surface friction or skin friction, while other sections of the suit (or portions thereof) can be constructed to have uneven exterior surface features that increase the roughness or surface friction/skin friction at such uneven surfaces and making such uneven exterior surfaces rougher (or have a greater roughness) in relation to the relatively smooth exterior surfaces. Specific examples of features that can be applied to a speed skating suit to enhance the smoothness or roughness at portions of the suit and also enhance its aerodynamic properties during use are described in co-pending U.S. patent application Ser. No. 14/994,709 ("the '709 application"), the disclosure of which is incorporated herein by reference in its entirety.

The size dimensions of the suit will vary based upon the size and configuration of the user so as to ensure a close and snug fit (e.g., a compression fit) is achieved between each suit and an individual user's body without limiting movement of body parts by the user. Further, while different materials are provided to form different portions of the suit, the suit can be formed as a single, integral (i.e., one piece) unit.

It is noted that, while a zipper is illustrated as a fastener in the embodiments of the figures, the fastener can be also implemented in any other suitable manner (e.g., utilizing button fasteners, snap fasteners, Velcro or hook-and-loop fasteners, etc.).

In addition, the present invention is not limited to use in speed skating environments but instead can be implemented for use in other contexts to enhance speed and performance of an athlete when moving through air or some other fluid. While examples of the suit described herein are in relation to speed skating athletic activities, the present invention is not limited to implementation for such activities but instead can be configured for use in a variety of other athletic activities including, without limitation, cycling activities, sledding activities, swimming activities, skiing activities, etc.

In a further embodiment, the suit may be configured as a swim suit which includes or excludes the arm sections, hood section and torso section. For example, the suit may be in the form of a swim suit or swim trunks that include two leg sections (left and right leg sections) connected together at a central or midsection that surrounds the hips of the wearer or user of the suit, where the leg sections extend to a location at or above the knees of the user. The assymetrical seams can be configured in the same or similar manner as the primary and secondary seam sections described herein and depicted in the suit of FIGS. 1-4.

Thus, it is intended that the present invention covers the modifications and variations of this invention provided they come within the scope of the appended claims and their equivalents. It is to be understood that terms such as "top", "bottom", "front", "rear", "left", "right", "side", "height", "length", "width", "upper", "lower", "interior", "exterior", and the like as may be used herein, merely describe points of reference and do not limit the present invention to any particular orientation or configuration.

What is claimed:

1. A suit wearable by a human user, the suit comprising:

a torso section;

two arm sections extending from an upper portion of the torso section, each arm section comprising an arm sleeve formed as a cylindrical tube having a length that extends from the upper portion of the torso section; and left and right leg sections extending from a lower portion of the torso section; and a pair of seams that connect portions of the suit together and extend across a leg section, wherein the seams of the pair are asymmetrical in relation to a lengthwise centerline axis of the suit;

wherein the seams of the pair define a first continuous fabric section of the suit that extends along a portion of the left leg section of the suit and further extends across a front side of the suit to cover a right hip portion and also a portion of a rear side of the suit, the first continuous fabric section being secured to other portions of the suit only by the pair of seams as the first continuous fabric section extends from the front side and around the right hip portion to the portion of the rear side of the suit.

2. The suit of claim 1, wherein the pair of seams comprise a primary seam section that extends laterally across a front side of the suit from a primary seam first location corresponding with the right leg section of the suit to a primary seam second location corresponding with the left leg side of the suit, and the first location is offset in the lengthwise dimension of the suit from the second location.

3. The suit of claim 2, wherein the primary seam first location is located above the right hip of the suit, and the primary seam second location is located at or below a left hip portion of the suit.

4. The suit of claim 2, further comprising a secondary seam section that is asymmetrical in relation to the lengthwise dimension of the suit, the secondary seam section being located below the primary seam section.

5. The suit of claim 4, wherein the secondary seam section connects portions of the suit together and extends laterally across the front side of the suit from a secondary seam first location corresponding with the right leg section of the suit to a secondary seam second location corresponding with a crotch location of the suit that defines a connection between the left and right leg sections.

6. The suit of claim 5, wherein the secondary seam first location is located at or below the right hip portion of the suit, and the secondary seam second location is offset in the lengthwise dimension of the suit in relation to the secondary seam first location.

7. The suit of claim 1, wherein one of the pair of seams further defines a second continuous fabric section of the suit that extends along a portion of the right leg section of the suit that connects with the first continuous fabric section at the one of the pair of seams.

8. The suit of claim 1, wherein one of a left side portion at a hip region of the suit and a right side portion at the hip region of the suit includes a greater number of seams in comparison to the other of the left and right side portions at the hip region of the suit.

9. The suit of claim 8, wherein the right side portion at the hip region of the suit has two seams, and the left side portion at the hip region of the suit has a single seam.

10. The suit of claim 1, further comprising:

a hood extending from an upper portion of the torso section, wherein the hood is configured to cover a portion of the human user wearing the suit.

11. A method of engaging in a sporting activity comprising:

wearing the suit of claim 1 while engaging in the sporting activity.

12. The method of claim 11, wherein the sporting activity comprises speed skating.

13. A suit wearable by a human user, the suit comprising:

left and right leg sections extending from a midsection of the suit;

wherein the leg sections comprise a first continuous fabric section of the suit that extends along a portion of the left leg section of the suit and further extends across a front side of the suit to cover a right hip portion and also a portion of a rear side of the suit, the first continuous fabric section being secured to other portions of the suit by a pair of seams, the seams of the pair being asymmetrical in relation to a centerline axis of the suit, and the first continuous fabric section is secured to the other portions of the suit only by the pair of seams as the first continuous fabric section extends from the front side and around the right hip portion to the portion of the rear side of the suit.

14. The suit of claim 13, wherein the right leg section further comprises a second continuous and seamless fabric section of the suit that extends along a portion of the right leg section of the suit that connects with the first continuous fabric section at one of the pair of seams.

* * * * *